US010287665B2

(12) United States Patent
Giordani et al.

(10) Patent No.: US 10,287,665 B2
(45) Date of Patent: May 14, 2019

(54) DRY LUBRICANT FOR ZINC COATED STEEL

(71) Applicant: Henkel AG & Co. KGaA, Duesseldorf (DE)

(72) Inventors: Paolo Giordani, Crema (IT); Mauro Rigamonti, Opera (IT); Reinhard Seidel, Windeck (DE); Roberto Galli, Spino d'Adda (IT); Luigi Dante Madonini, Crema (IT); Hans Clodt, Essen (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 15/381,676

(22) Filed: Dec. 16, 2016

(65) Prior Publication Data

US 2017/0145551 A1 May 25, 2017

Related U.S. Application Data

(63) Continuation of application No. PCT/EP2015/063457, filed on Jun. 16, 2015.

(30) Foreign Application Priority Data

Jun. 27, 2014 (DE) ..... 10 2014 212 464

(51) Int. Cl.

| | |
|---|---|
| ***C23C 2/06*** | (2006.01) |
| ***C23C 2/26*** | (2006.01) |
| ***C23C 22/78*** | (2006.01) |
| ***C25D 11/36*** | (2006.01) |
| *C25D 5/48* | (2006.01) |
| *C25D 7/06* | (2006.01) |

(52) U.S. Cl.
CPC ..... *C23C 2/06* (2013.01); *C23C 2/26* (2013.01); *C23C 22/78* (2013.01); *C25D 11/36* (2013.01); *C25D 5/48* (2013.01); *C25D 7/0614* (2013.01)

(58) Field of Classification Search
CPC ..... C23C 2/02; C23C 2/06; C23C 2/26
See application file for complete search history.

(56) References Cited

U.S. PATENT DOCUMENTS

| | | | | |
|---|---|---|---|---|
| 2,743,205 | A * | 4/1956 | Condon | C23C 22/78 106/14.12 |
| 4,381,203 | A | 4/1983 | Reinhold | |
| 5,178,690 | A | 1/1993 | Maiquez | |
| 5,660,707 | A | 8/1997 | Shastry et al. | |
| 5,976,272 | A * | 11/1999 | Seidel | C23C 22/12 148/261 |
| 6,231,686 | B1 | 5/2001 | Eierman | |
| 6,528,182 | B1 | 3/2003 | Bello | |
| 8,221,900 | B2 | 7/2012 | Makimizu et al. | |
| 8,623,514 | B2 | 1/2014 | Makimizu et al. | |
| 2003/0118861 | A1 * | 6/2003 | Heimann | C04B 28/26 428/632 |
| 2008/0308192 | A1 | 12/2008 | Bello et al. | |
| 2011/0011498 | A1 | 1/2011 | Gentschev et al. | |

FOREIGN PATENT DOCUMENTS

| | | | | |
|---|---|---|---|---|
| EP | 1115914 | B1 | 4/2003 | |
| EP | 0935014 | B1 | 9/2004 | |
| EP | 1115915 | B1 | 7/2005 | |
| EP | 1699947 | | 9/2006 | |
| EP | 2450470 | | 5/2012 | |
| EP | 1678345 | B1 | 11/2013 | |
| EP | 2851452 | A1 | 3/2015 | |
| GB | 1090310 | A * | 11/1967 | C23C 22/60 |
| JP | 2000328220 | A | 11/2000 | |
| RU | 2387738 | C2 | 4/2010 | |

OTHER PUBLICATIONS

International Search Report for PCT/EP2015/063457, dated Oct. 7, 2015.

* cited by examiner

*Primary Examiner* — Nathan H Empie
(74) *Attorney, Agent, or Firm* — Mary K. Cameron

(57) ABSTRACT

The present invention relates to the use of an alkaline, aqueous coating composition for coating of zinc or zinc alloy coated steel substrates, comprising one or more alkaline sulfates, and one or more alkaline carbonates, wherein the pH of the composition ranges from 9-12. The present invention also defines a method for the non-reactive coating of zinc or zinc alloy coated steel substrates by use of said compositions and further relates to the application of said method as a surrogate for pre-phosphating of zinc or zinc alloy coated steel substrates in industrial applications.

16 Claims, No Drawings

DRY LUBRICANT FOR ZINC COATED STEEL

The present invention relates to the use of an aqueous coating composition comprising alkaline sulfates and alkaline carbonates for coating of zinc or zinc alloy coated steel sheets as well as to a method for the usage of such compositions.

In industry in general, but especially in the automotive field, steel sheets coated with zinc or zinc alloys are used widely, as they exhibit excellent corrosion resistance. Generally, phosphating and pre-phosphating of such steel surfaces is applied in industrial working processes to further improve corrosion resistance, but also lubricity and painting adhesion promotion. Special preference is held for hot dip galvanized (HDG) steel, but since pre-phosphate coatings on that sort of steel are neither removable nor weldable, the automotive industry currently is drawing back from standard pre-phosphated galvanized steel, and the need for more innovative technologies prevails.

As an alternative process to pre-phosphating US 2008/0308192 discloses the treatment of zinc coated steel with an aqueous composition comprising sulfates, especially zinc sulfates, in order to form specific zinc hydroxysulfate coatings that confer temporary corrosion resistance and lubricative properties to zinc coated steel.

The objective of the present invention consists in establishing a coating of zinc that provides excellent temporary corrosion protection as well as significant lubricative properties while a subsequent phosphating step is not negatively influenced. It is yet another objective of the invention that the coating can be accomplished in a few process steps without intermediate rinsing steps and successfully applicable to all types of zinc or zinc alloy coated steel, including hot-dip galvanized steel.

The present invention meets this object and provides a dry-in-place method for coating of zinc surfaces for the substitution of currently applied pre-phosphating cycles. A dry-in-place method of this invention provides coatings that are capable of being directly phosphatized in a subsequent process step. Thus, the inventive coatings offer reduced process complexity, help reduce processing costs, involve no heavy metals, allow for lubricant absorption necessary for formability, offer good corrosion resistance, have no negative impact on subsequent phosphating processes, and are applicable for all types of zinc alloys including hot-dip galvanized steel with little to no etching of the surface.

In a first aspect, the present invention thus relates to the use of an aqueous coating composition for coating zinc and zinc alloy coated steel substrates, wherein the composition includes:

(i) one or more alkaline sulfates, and (ii) one or more alkaline carbonates, wherein the pH of the composition ranges from 9 to 12, preferably from 10.2 to 11.5.

In another aspect, the present invention is also directed to a method for coating of zinc or zinc alloy steel substrates, wherein the method comprises (a) coating the zinc or zinc alloy coated steel substrate with a wet film of an aqueous coating composition having a pH of from 9 to 12 , preferably 10.2 to 11.5, and comprising:
   (i) one or more alkaline sulfates,
   (ii) one or more alkaline carbonates, (b) drying the coated wet film on the zinc or zinc alloy coated steel substrate at temperatures in the range of 40-100° C.

Regarding the application of the innovative coating solution on the substrate in the coating step, suitable application techniques include, without limitation, dipping of the steel sheets, panels or coils into said solution, spraying said solution onto the steel sheet, panel or coil surface, and mechanical application of said solution onto the surface of steel sheets, panels or coils utilizing squeegees or chemcoater technology.

The coating compositions described herein are non-reactive coating compositions. Non-reactive coating compositions form coatings on the metal or metal alloy substrate they are applied on by physical deposition and not by chemical conversion. Thus, less to no etching of the metal or metal alloy substrate is caused, rendering this method more conciliatory in comparison to conversion-based coatings. Consequently, in a preferred embodiment of this invention only the use of such coating compositions is encompassed which reveal an etching rate of less than 0.01 $g/m^2$ per hour with respect to the element Zn when a pure zinc panel (>99 At. % Zn) is dipped in an unstirred coating composition at 25° C. The dissolved amount of zinc is measured within the coating composition by making use of ICP-OES after rinsing-off the adhering wet film from the zinc panel with deionized water ($\kappa<1$ μScm-1) and acidifying the coating composition with a 18 wt.-% aqueous solution of hydrochloric acid.

The contact time of the innovative solution with the surface of steel sheets, panels or coils lies in the range of fractions of seconds to a few seconds, depending on the manner of application, and does not affect the weight of the coating or its properties.

The coating weight of the coatings formed with the innovative solution on the surface of steel sheets, panels or coils is dependent on the dry matter concentration as well as the manner of application of said solution. The typical coating weight for the automotive industry is 0.05 to 1.0 $g/m^2$ and preferably lies in the range of 0.1 to 0.4 $g/m^2$. The "coating weight" in the context of this invention equals the weight difference between a zinc coated steel substrate sample being coated according to a method of this invention, while in such method drying is performed at 80° C. under 1 atm. for 900 seconds, and the same sample after having been exposed to deionized water ($\kappa<1$ μScm-1) for 120 seconds at 50° C., rinsed with deionized water ($\kappa<1$ μScm-1) for 10 seconds at 20° C., blow-dried with nitrogen and thereafter dried at 80° C. under 1 atm. for 900 seconds.

The coating compositions of the present invention are aqueous, alkaline systems, more particularly solutions with demineralized water as the solvent, prepared from solid raw or pre-dissolved materials.

These aqueous coating compositions comprise alkaline salts, and may further encompass minor contents of sequestrant agents and surfactants to control minor pollutions and improve homogeneity of the solutions for optimal coating conditions as well as minor amounts of silicates that support the adhesion of the dried coating to the zinc coated steel.

Processing temperatures may range from 10 to 50° C., but preferably lie in the range of 15 to 35° C.

The pH of the coating composition lies in the range of 9 to 12, and preferably of 10.2 to 11.5.

Both, moderate processing temperature and medium range pH-values minimize corrosion and prevent zinc dissolution from the substrate. The "pH value" according to this invention relates to the negative logarithm to base 10 of the activity of hydronium ions at a temperature of 25° C. in a coating composition of this invention.

Suitable salts are water-soluble in alkaline pH range and comprise, but are not limited to, water soluble metal salts, preferably alkaline metal salts, but also non-metal salts such as ammonium salts. In various embodiments, the aqueous coating composition has a total dry salt concentration in the range of 14-200 g/l, preferably 14-100 g/l and even more preferably between 25-70 g/l.

The term "water soluble" in the context of this invention shall refer to compounds with a solubility of at least 50 g/l at 25° C. in deionized water (κ<1 μScm-1).

The term "total dry salt concentration" in the context of this invention shall mean the amount of salts that remain on a substrate after loading a surface area of 1 $m^2$ of the substrate with a wet film of the coating composition in a wet film thickness of 1 mm and drying the wet film thereafter at 80° C. under 1 atm. for 900 seconds.

The one or more alkaline sulfates contained in the aqueous coating composition may be selected from the group consisting of metal sulfates and non-metals sulfates, wherein the metal sulfates are preferably alkaline metals sulfates, and more preferably sodium or potassium sulfate, and wherein the non-metal sulfate is preferably ammonium sulfate. In various embodiments, the total alkaline sulfate concentration of the aqueous coating composition is in the range from 7-100 g/l, preferably from 7-55 g/l and even more preferably from 20-30 g/l.

The one or more alkaline carbonates in the aqueous coating composition may be selected from the group consisting of metal carbonates and non-metal carbonates. The metal carbonates are preferably alkaline metal carbonates, more preferably sodium carbonate, and wherein the non-metal carbonate is preferably ammonium carbonate. In various embodiments, the total alkaline carbonate concentration of the aqueous coating composite is in the range from 0.5-40 g/l, preferably from 1.7-23 g/l, more preferably from 3.0 g/l to 23 g/l.

Minor amounts of silicates may preferably be added to a coating composition according to the use of this invention. The silicates that can be used are not particularly limited, the preferred silicate salt used is sodium metasilicate. In a preferred use of this invention, the silicates are contained in the coating composition in an amount that gives rise to an elemental loading of less than 2.0 mg/$m^2$ with respect to the element Si, preferably of less than 1.0 mg/$m^2$, more preferably of less than 0.8 mg/$m^2$ to prevent negative impacts on subsequent phosphating processes of the zinc coated steel substrate. In preferred embodiments, the silicates are contained in the coating composition in an amount that gives rise to an elemental loading of at least 0.1 mg/$m^2$ with respect to the element Si. The term "elemental loading" in the context of this invention refers to the absolute amount of the respective element on top of the zinc coated steel substrate as applied according to the use of this invention and may be determined by any suitable method known by the skilled person, e.g. X-ray fluorescence analysis (XRF).

In some preferred embodiments, the coating composition may further comprise sequestrants to avoid precipitations within the coating composition as well as surfactants to ensure a homogeneous coating result.

The sequestrant may be a water-soluble sequestrant, preferably selected from the group consisting of ethylenediaminetetraacetic acid (EDTA), α-hydroxy-carboxylic acids, nitrilodiacetic acid (NTA) and other chelating agents, preferably α-hydroxy-carboxylic acids, more preferably gluconate, and especially preferred sodium gluconate. In a preferred embodiment the weight fraction of chelating agents in the form of their sodium salts is at least 0.5 wt. %, but preferably less than 10 wt. %, more preferably less than 5 wt. % based on the total dry salt concentration of the coating composition.

Surfactants can help to increase wetting and homogeneity of the coating. The surfactant used may preferably be a non-ionic low foam surfactant.

Coating uniformity can also be improved by using in addition, water-soluble film forming materials being preferably selected from polyethylene glycols, polyacrylates, polyvinylpyrrolidone, maleic anhydride polymer and copolymers.

For specific applications the coating composition may additionally contain a lubricating agent in a water soluble or water dispersed form being preferably selected from oxidized polyethylenes or polypropylenes as well as polyalkylene glycols or polyalkylene modified waxes.

In a preferred embodiment the coating composition for the use according to this invention comprises less than 0.1 g/l of water insoluble inorganic phosphate salts calculated as $PO_4$. According to this preferred aspect of this invention the coating composition preferably also comprises less than 1 g/l of water soluble inorganic phosphates salts calculated as $PO_4$ in order to minimize any interference with a subsequent phosphating step. The amount of water soluble inorganic phosphate salts is to be determined in the filtrate of a cross-flow filtration performed under such conditions for which the filter provides a filter efficiency of 90% with respect to $SiO_2$ particles and a particle size of 10 nm as measured with dynamic light scattering methods known in the art.

In some preferred embodiments, the coating composition may further comprise only minor amounts of borates as their presence might deteriorate the performance of a subsequent phosphating step. Consequently, the coating compositions do preferably contain less than 1.0 g/l, more preferably less than 0.1 g/l of borates calculated as $BO_3$.

Moreover, the coating composition shall not comprise such amounts of electropositive metal ions that are capable of metallization of the zinc surface of the steel substrates. Consequently, those coating compositions are preferred wherein the total amount of elements Ni, Co, Cu, Sn and/or Ag is less than 0.1 g/l, more preferably less than 0.01 g/l.

In addition, the coating composition shall preferably not comprise efficient amounts of metal ions that are capable of forming inorganic conversion coatings. Consequently, those coating compositions are preferred wherein the total amount of elements Zr, Ti, Mo and/or Cr is less than 0.1 g/l, more preferably less than 0.01 g/l.

Furthermore, the coating composition shall preferably not comprise a certain amount of metal ions that are capable of forming deposits that might interfere with the formation of a dry-in-place coating. Consequently, those coating compositions are preferred wherein the total amount of elements Zn and/or Fe is less than 1 g/l. preferably less than 0.5 g/l.

In the methods described herein, the aqueous compositions disclosed above in connection with the inventive uses may be similarly used. In the methods as well as the above-described uses, the coating composition is typically applied in such amounts that the final coating weight after drying is 0.05 to 1.0 g/$m^2$, preferably 0.1 to 0.4 g/$m^2$. In various embodiments of the disclosed methods, the processing temperature of the coating composition lies in the range of 10-50° C., preferably between 15-35° C. The "final coating weight after drying" in the context of this invention describes the coating weight that remains on a substrate after drying of a wet film of the coating composition with a liquid loading of not more than 4 ml/m$^2$ at 80° C. under 1 atm. for 900 seconds.

The described coating of zinc and zinc alloy coated steel substrates is preferably applied as a substitute for pre-phosphating and as such may be performed prior to final phosphating of the zinc or zinc alloy coated steel substrates. Thus, in a preferred method of this invention the application of a wet film of the coating composition on the zinc or zinc alloy coated steel substrate after being dried to yield the coating ("Dry-in-Place Method") is followed by a phosphating step (c) while preferably in between no intermediate wet chemical surface treatment step based on aqueous solutions is performed. A "phosphating step" according to this invention encompasses process sequence steps selected from cleaning, rinsing, activation and phosphating that yields a coating weight of at least 1 g/m$^2$ of a phosphate layer calculated with respect to $PO_4$. Such process sequence steps being generally known to a skilled person in the art of metal surface treatment.

The method described herein may be used in industrial coating applications for zinc or zinc alloy coated steel substrates, including, without limitation, electro-galvanized, hot dip galvanized steel and Galvannealed™ substrates. Such processes may involve oiling of the zinc or zinc alloy coated steel surface that have been coated with the coating compositions described herein and subsequently dried to improve lubrication and formability. Therefore, in a preferred embodiment of the method of this invention the surfaces of the zinc coated steel substrates are loaded with an oil film subsequent to step (b), more preferably directly after step (b) but prior to any phosphating step (c).

EXAMPLES

Part 1: Corrosion Resistance

Zinc—hot dipped galvanized (HDG) steel panels (20×10 cm) were treated according to the following sequence:

cleaning
dip rinse (tap water)
drying (compressed air)
coating: 25° C., 5 seconds, dip
squeezing to 4 ml/m$^2$
drying (oven, 80° C., 900 seconds)
surface loading with 1 g/m$^2$ of RP 4107 S (oil commercially available from Fuchs Petrolub SE)

TABLE 1a

| Solution | A1 | A2 | B1 | B2 |
|---|---|---|---|---|
| $Na_2SO_4$ | 9.7 g/l | 19.4 g/l | 10.7 g/l | 21.4 g/l |
| $K_2SO_4$ | 26.4 g/l | 52.8 g/l | 28.7 g/l | 57.4 g/l |
| $Na_2CO_3$ | 5.5 g/l | 11.0 g/l | 7.2 g/l | 14.4 g/l |
| Sodium gluconate | 0.2 g/l | 0.4 g/l | 1.2 g/l | 2.4 g/l |
| Coating Weight 1 | 0.15 g/m$^2$ | 0.3 g/m$^2$ | 0.15 g/m$^2$ | 0.3 g/m$^2$ |

1 The coating weight is determined by measuring the weight difference between the sample after step 6 and the same sample after the following treatment:
dip in deionized water (κ < 1 μScm−1) at 50° C. for 10 minutes;
remove and rinse with deionized water (κ < 1 μScm−1) at 20° C. for 10 seconds; and
blowing clean compressed air to remove adherent wet film; and
drying at 80° C. under 1 atm. for 15 minutes Table 1a depicts the recipes for each coating composition being tested under step 3 of the above-mentioned process sequence as well as the yielded coating weights after step 6 of the above-mentioned process sequence.

After treatment the steel panels were evaluated according to the DIN 50 017-KTW test:

Test specimens were placed in an enclosed chamber, and exposed to a changing climate that comprised the following two part repeating cycle:

8 hours exposure to a heated, saturated mixture of air and water vapor at temperatures of +40° C. and a relative humidity of 100% RH followed by 16 hours exposure to room temperature (+18 to +28° C. according to DIN 50 014) whilst the relative humidity is maintained at 100% RH.

Table 1b shows the degree of corrosion after 5 cycles of the above-mentioned test procedure.

TABLE 1b

| Sample | Coating | Corrosion % |
|---|---|---|
| 0 | none | 10 |
| 1 | A1 | 3 |
| 2 | A2 | 2 |
| 3 | B1 | 2 |
| 4 | B2 | 1 |

Part 2: Lubricity

Zinc coated steel stripes (40×5 cm) were coated and subsequently charged with 1.0 g/m$^2$ of a certain lubricative oil commercially available from Fuchs Petrolub SE (see table 2a). While for panel sample EG-1 a dry-in-place coating based on a commercial available reactive coating composition from Henkel AG & Co. KGaA was applied, the other samples were coated according to this invention.

The zinc coated steel stripes were processed according to the following sequence:

1. cleaning
2. dip rinse (tap water)
3. drying (compressed air)
4. coating: 25° C., 5 seconds, dip
5. squeezing to 1 ml/m$^2$ (C1; C2) or 1.5 ml/m$^2$ (C3; C4)
6. drying (oven, 80° C., 900 seconds)
7. oil deposition Table 2a lists the recipes of the coating compositions applied in step 4 of the above-mentioned process sequence, while Table 2b depicts the coating weight yielded after step 6 of the above-mentioned process sequence as well the type of oil loaded to each dried steel strip.

TABLE 2a

| Solution | C1 | C2 | C3 | C4 |
|---|---|---|---|---|
| $Na_2SO_4$ | 11.6 g/l | 23.1 g/l | 8.9 g/l | 17.8 g/l |
| $K_2SO_4$ | 32.0 g/l | 55.8 g/l | 23.9 g/l | 47.8 g/l |
| $Na_2CO_3$ | 6.7 g/l | 13.3 g/l | 6.0 g/l | 12.0 g/l |
| Sodium gluconate | 0.4 g/l | 0.7 g/l | 1.0 g/l | 2.0 g/l |

TABLE 2b

| Sample | Coating | Coating weight | Oil for forming |
|---|---|---|---|
| 0 | none | // | PL 3802-39 S |
| EG-1 | Granodine ® 5895 | 0.2 g/m$^2$ | PL 3802-39 S |
| EG-2 | C1 | 0.05 g/m$^2$ | PL 3802-39 S |
| EG-3 | C2 | 0.1 g/m$^2$ | PL 3802-39 S |
| GA-4 | C2 | 0.1 g/m$^2$ | PL 3802-39 S |
| HDG-1 | C3 | 0.05 g/m$^2$ | RP 4107 S |
| HDG-1 | C4 | 0.11 g/m$^2$ | RP 4107 S |

EG Electrogalvanized Steel
GA Galvannealed Steel
HDG Hot Dip Galvanized Steel

The test stripes were then evaluated with a tribometric test using "QUIRY HYDROMAXE 2B" machine:

The sample was coated with a lubricant. While the sample was squeezed horizontally between two flat dies, a vertical traction device pulled it up. The friction coefficient (μ) of the lubricant is the ratio of the traction force to the pressing force.

Parameters of the Test:

Pressing force, daN: 500 (see Table 2c); 0-800 (see Table 2d)

Pressing force gradient, daN/s: constant

Speed, mm/min: 20

Number of cycles: up to 10

Table 2c lists the corresponding tribometric test results with regard to the friction coefficient at different pressing forces while Table 2d resembles the test results with regard to the maximum friction coefficient.

TABLE 2c

| | | friction coefficient (μ) at different pressing forces | | | |
|---|---|---|---|---|---|
| Sample | Coating | 200 daN | 400 daN | 600 daN | 800 daN |
| HDG-0 | none | 0.153 | 0.129# | 0.096 | 0.078 |
| HDG-1 | E1 | 0.096 | 0.079 | 0.064 | 0.058 |
| HDG-2 | E2 | 0.101 | 0.082 | 0.069 | 0.063 |

HDG Hot Dip Galvanized Steel
#sticking and overheating - trial stopped

TABLE 2d

| | | Max friction coefficient (μ) during different cycles | | | |
|---|---|---|---|---|---|
| Sample | Coating | Cycle 2 | Cycle 4 | Cycle 6 | Cycle 10 |
| EG-0 | none | 0.279 | 0.514# | // | // |
| EG-1 | Granodine 5895 | 0.183 | 0.202 | 0.248# | // |
| EG-2 | C1 | 0.105 | 0.123 | 0.174 | 0.206 |
| EG-3 | C2 | 0.091 | 0.093 | 0.094 | 0.105 |
| GA-1 | C2 | 0.108 | 0.125 | 0.172 | 0.249 |

EG Electrogalvanized Steel
GA Galvannealed Steel
#sticking and overheating - trial stopped Part 3: Dissolution Tests on Zinc Coated Steel Alloys The effect of certain coating compositions on the zinc dissolution rate is shown in Table 3a.

The evaluations were made putting hot dipped galvanized (HDG) steel panels in contact with the respective coating composition for 24 hours as well as 48 hours at two different temperatures (25° C. and 40° C.). For each contact time, a different solution/panel was used. At the evaluation time, the panel was gently rinsed and removed; the solution was acidified with HCl 1:1 to dissolve possible precipitates formed and the dissolved zinc was then measured with ICP-OES.

TABLE 3a

| | | T = 25° C. | | T = 40° C. | |
|---|---|---|---|---|---|
| | Solution composition, g/l. | t = 24 h Zn, mg/m$^2$ | t = 48 h Zn, mg/m$^2$ | t = 24 h Zn, mg/m$^2$ | t = 48 h Zn, mg/m$^2$ |
| 1 | $K_2SO_4$, 52/$Na_2SO_4$, 19 | 227 | 570 | 442 | 2075 |
| 2 | $K_2SO_4$, 51/$Na_2SO_4$, 19/ $Na_2CO_3$, 1 | 212 | 495 | 370 | 2137 |
| 3 | $K_2SO_4$, 50/$Na_2SO_4$, 18.5/ $Na_2CO_3$, 2.5 | 152 | 277 | 235 | 572 |
| 4 | $K_2SO_4$, 48/$Na_2SO_4$, 17.5/ $Na_2CO_3$, 5 | 185 | 148 | 85 | 190 |
| 5 | $K_2SO_4$, 45/$Na_2SO_4$, 16.5/ $Na_2CO_3$, 9.5 | 55 | 123 | 157 | 152 |
| 10 | $K_2SO_4$, 26/$Na_2SO_4$, 9.5/ $Na_2CO_3$, 35.5 | 85 | 62 | 82 | 85 |
| 11 | $Na_2CO_3$, 71 | 177 | 265 | 237 | 231 |

The invention claimed is:

1. A method for coating zinc or zinc alloy coated steel substrates, comprising:

contacting a zinc or zinc alloy coated steel substrate with an aqueous composition comprising:

(i) one or more alkaline sulfates selected from the group consisting of sodium sulfate, potassium sulfate, ammonium sulfate, and mixtures thereof, (ii) one or more alkaline carbonates selected from the group consisting of alkaline metal carbonates, ammonium carbonate, and mixtures thereof, and (iii) 0 to less than 1 g/l of water soluble inorganic phosphate salts calculated as $PO_4$;

wherein pH of the composition ranges from 9-12;

drying the aqueous composition on the zinc or zinc alloy coated steel substrate without intermediate rinsing, thereby forming a coating having a coating weight after drying of 0.05 to 1.0 g/m$^2$.

2. The method of claim 1, wherein the total alkaline sulfate concentration of the aqueous coating composition is 7-100 g/l.

3. The method of claim 1, wherein the one or more alkaline carbonates in the aqueous coating composition are selected from the group consisting of sodium carbonate, ammonium carbonate, and mixtures thereof.

4. The method of claim 1, wherein the total alkaline carbonate concentration of the aqueous coating composition is 0.5-40 g/l.

5. The method of claim 1, wherein the coating composition additionally comprises chelating agents selected from α-hydroxy-carboxylic acids.

6. The method of claim 5, wherein the weight fraction of chelating agents in the form of their sodium salts is at least 0.5 wt. %, but less than 10 wt. % based on a total dry salt concentration of the coating composition.

7. The method of claim 1, wherein the coating composition additionally comprises silicates.

8. The method of claim 7, wherein the silicates are contained in the coating composition in an amount that gives rise to an elemental loading of less than 2.0 mg/m$^2$, but at least 0.1 mg/m$^2$ with respect to the element Si.

9. The method according to claim 1, wherein the aqueous coating composition has a total dry salt concentration in a range of 14-200 g/l.

10. A method for coating of zinc or zinc alloy steel substrates, wherein the method comprises:

(a) coating a zinc or zinc alloy coated steel substrate with a wet film of an aqueous coating composition having a pH of 10.2-11.5 and comprising:

(i) 7-100 g/l of one or more alkaline sulfates selected from the group consisting of sodium sulfate, potassium sulfate, ammonium sulfate, and mixtures thereof;

(ii) 0.5-40 g/l of one or more alkaline carbonates selected from the group consisting of alkaline metal carbonates, ammonium carbonate, and mixtures thereof; and (iii) 0 to less than 1 g/l of water soluble inorganic phosphate salts calculated as $PO_4$;

(b) drying the coated wet film on the zinc or zinc alloy coated steel substrate at temperatures in a range of 40-100° C.

11. The method according to claim 10, wherein the temperature of the aqueous coating composition during step (a) lies in a range of 15-35° C.

12. The method according to claim 10, wherein subsequent to step (b) a phosphating step (c) is conducted.

13. The method according claim 12, wherein subsequent to step (b) the surfaces of the zinc coated steel substrates are loaded with an oil film, prior to any phosphating step (c).

14. The method according to claim 1, wherein components (i), (ii) and (iii) are selected such that the coating composition has an etching rate of less than 0.01 $g/m^2$ per hour with respect to the element Zn.

15. The method according to claim 10, wherein the coating composition of step (a), additionally comprises:

(iv) chelating agents selected from α-hydroxy-carboxylic acids present in a weight fraction in the form of their sodium salts of at least 0.5 wt. %, but less than 10 wt. % based on a total dry salt concentration of the coating composition; and (v) silicates present in an amount that gives rise to an elemental loading of less than 0.8 $mg/m^2$, with respect to the element Si; and final coating weight after drying step (b) is 0.1 $g/m^2$ and an absolute amount of the element Si on top of the zinc coated substrate being at least 0.1 $mg/m^2$ and less than 0.8 $mg/m^2$.

16. A method for coating zinc or zinc alloy coated steel substrates, comprising the steps of:

(a) coating a zinc or zinc alloy coated steel substrate with a wet film of an aqueous composition having pH from 9-12 and temperature from 15-35° C. consisting of:

(i) 7-100 g/l of one or more alkaline sulfates selected from the group consisting of sodium sulfate, potassium sulfate, ammonium sulfate, and mixtures thereof, (ii) 0.5-40 g/l of one or more alkaline carbonates selected from the group consisting of alkaline metal carbonates, ammonium carbonate, and mixtures thereof, (iii) 0 to less than 1 g/l of water soluble inorganic phosphate salts calculated as $PO_4$, (iv) less than 0.1 g/l of a total amount of Zr, Ti, Mo, and Cr, (v) optionally, a weight fraction between 0.5 wt % and 10 wt. % based on the total dry salt concentration of the coating composition of a water soluble sequestrant selected from the group consisting of ethylenediaminetetraacetic acitd (EDTA), α-hydroxy-carboxylic acids, nitrilodiacetic acid (NTA), gluconate sodium gluconate, and mixtures thereof, and (vi) optionally, an amount of silicates that results in an elemental loading on the substrate of less than 2.0 $mg/m^2$ but at least 0.1 $mg/m^2$ with respect to the element Si;

wherein the aqueous coating composition has a total dry salt concentration in a range of 14-200 g/l; and (b) drying the coated wet film on the zinc or zinc alloy coated steel substrate at temperatures in a range of 40-100° C., such that the dried film has a final coating weight;

wherein the final coating weight after drying is 0.05 to 1.0 $g/m^2$.

* * * * *